US005648768A

United States Patent [19]

Bouve

[11] Patent Number: 5,648,768

[45] Date of Patent: Jul. 15, 1997

[54] SYSTEM AND METHOD FOR IDENTIFYING, TABULATING AND PRESENTING INFORMATION OF INTEREST ALONG A TRAVEL ROUTE

[75] Inventor: Thomas Tracy Bouve, Alexandria, Va.

[73] Assignee: Mapsys, Inc., Alexandria, Va.

[21] Appl. No.: 366,642

[22] Filed: Dec. 30, 1994

[51] Int. Cl.[6] ..... G08G 1/123

[52] U.S. Cl. ..... 340/988; 340/905; 340/995; 364/449.1

[58] Field of Search ..... 340/988, 905, 340/990, 995; 364/444, 449; 73/178 R; 342/457

[56] References Cited

U.S. PATENT DOCUMENTS

| | | | |
|---|---|---|---|
| 4,546,439 | 10/1985 | Esparza | 340/995 |
| 4,570,227 | 2/1986 | Tachi et al. | 340/995 |
| 4,630,209 | 12/1986 | Saito et al. | 340/995 |
| 4,646,089 | 2/1987 | Takanabe et al. | 340/995 |
| 4,675,676 | 6/1987 | Takanabe et al. | 340/995 |
| 4,951,211 | 8/1990 | De Villeroche | 340/995 |
| 4,951,212 | 8/1990 | Kurihara et al. | 340/995 |
| 4,974,170 | 11/1990 | Bouve et al. | 340/995 |
| 5,021,961 | 6/1991 | Ross et al. | 340/990 |
| 5,031,104 | 7/1991 | Ikeda et al. | 340/995 |
| 5,146,219 | 9/1992 | Zechnall | 340/995 |
| 5,172,321 | 12/1992 | Ghaem et al. | 340/995 |
| 5,220,507 | 6/1993 | Kirson | 340/995 |
| 5,371,678 | 12/1994 | Nomura | 340/995 |
| 5,424,951 | 6/1995 | Nobe et al. | 340/995 |
| 5,442,557 | 8/1995 | Kaneko | 340/995 |

*Primary Examiner*—Brent A. Swarthout
*Attorney, Agent, or Firm*—Lowe, Price, LeBlanc & Becker

[57] ABSTRACT

A system for identifying and presenting information relating to travel within a geographic region, has a data base for storing a plurality of travel routes within the geographic region and one or more types of travel information associated with one or more of the plurality of travel routes. A keyboard or other device is provided to input first and second geographic locations within the geographic region to the system. A computer processor retrieves at least one travel route between the first and second geographic locations from the stored plurality of travel routes. The processor also retrieves travel information corresponding both to at least one type of travel information and to the retrieved travel route(s) from the stored types of travel information. A display, printer or voice synthesizer presents the retrieved travel route(s) and travel information to a user of the system. The processor also computes cumulative mileage and travel time indicators which locate items of retrieved travel information with respect to the selected travel route.

14 Claims, 3 Drawing Sheets

SYSTEM AND METHOD FOR IDENTIFYING, TABULATING AND PRESENTING INFORMATION OF INTEREST ALONG A TRAVEL ROUTE

TECHNICAL FIELD

This invention relates to electronic travel routing, and more particularly to a system and method for identifying and presenting information of interest to a traveler along a travel route.

DESCRIPTION OF THE RELATED ART

Knowing the locations of facilities, occurrences and other information of interest to a traveler along a travel route before beginning a road trip, and while enroute, is highly useful to travelers because they can then accurately plan their trip and anticipate enroute problems and circumstances. Enroute information that is of particular interest to travelers are facilities (such as lodging and restaurants), landmarks (such as toll bridges and metropolitan area boundaries), incidents (such as traffic accidents), and conditions (such as icy roads and road construction).

Trip planning is time-consuming for travelers in part because of the difficulty in obtaining desired information; obtaining this information along unfamiliar travel routes is particularly demanding. The traveler must first identify the route of travel, on a desired type of route, such as the most direct or most scenic route. Usually, this involves considerable roadmap measurement, and estimates of travel distances and times. Then, for a traveler to know the locations of certain enroute facilities, such as lodgings, travel directories must be examined to identify which lodgings are located along the route of travel, and then, typically using roadmaps, painstakingly determine the locations of these facilities along the travel route in order to approximate travel distances to and between each facility so as to plan enroute stopping points. Identifying enroute landmarks, such as bridges or junction points with other routes, likewise requires examining roadmaps and measuring distances as well. Enroute incidents, such as traffic congestion areas, involve different forms of information gathering such as listening to local radio broadcast while travelling. Anticipating weather conditions involves a review of weather information and correlating it to the travel route thereby involving further map examination.

It is an object of the present invention to provide a system and method for identifying and presenting information of interest to a traveler without the traveler experiencing the problems discussed above.

It is a further object of the present invention to provide a system and method for providing information of interest to a traveler along a travel route which does not require the traveler to access various different information sources and which substantially reduces the time which a traveler must expend to obtain the desired information.

Additional objects, advantages and novel features of the present invention will become apparent to those skilled in the art from this disclosure, including the following detailed description, as well as by practice of the invention. While the invention is described below with reference to preferred embodiments, it should be understood that the invention is not limited thereto. Those of ordinary skill in the art having access to the teachings herein will recognize additional applications, modifications and embodiments in other fields, which are within the scope of the invention as disclosed and claimed herein and with respect to which the invention could be of significant utility.

SUMMARY OF THE INVENTION

In accordance with the present invention, a system for identifying and presenting information relating to travel within a geographic region is provided with a local or central computer processing unit, and electronic or magnetic data storage device. The data storage device may be a hard disk, compact disc (CD), ROM memory or other electronic or magnetic data storage device. One or more data bases residing on the storage device have a plurality of travel routes within the geographic region as well as one or more types of travel information, such as eateries, hotels/motels, road construction areas, weather or other information useful to a traveler, and associated with one or more of the plurality of travel routes. A keyboard, voice recognition subsystem or other input device is used to input first and second geographic locations within the geographic region and between which the user desires to travel. Responsive to the inputted geographical locations, a computer processing unit retrieves at least one travel route between the first and second geographic locations, from the stored plurality of travel routes. The processor also retrieves travel information corresponding to the retrieved travel route(s), from the stored types of travel information. A presentation device such as a display, printer or voice synthesizer is provided for presenting the retrieved travel route(s) and travel information to the user.

Preferably, a plurality of different types of travel information are stored and at least one type of travel information is selected by the user and identified by an input to the system. Accordingly, the processing unit retrieves the travel information corresponding to the selected type(s) of travel information. Each of the stored plurality of travel routes may also correspond to a category of roadway, such as an interstate highway, scenic route, dirt road etc. The user can input a selected category of roadway and the processing unit will retrieve a travel route(s) corresponding to the selected category of roadway. Once the route(s) and travel information are retrieved, the processor can tabulate the retrieved routes and travel information and store the tabulated information in the data storage device for future reference. The processor also calculates mileage and/or travel time indicators to locate each item of retrieved travel information with respect the to retrieved route(s).

If a central computer processor and storage device are utilized, signals corresponding to the user input are transmitted to the central processor and signals corresponding to the retrieved travel route(s) and travel information are transmitted to the presentation device for presentation to the user, via a communications link or network. The user can access the system using an input device in his/her residence or automobile, or from a kiosk or personal computing device, which is remote from the central storage device. The communications link or network may include wire, optical, cellular or satellite communications links.

According to the method of the present invention, information relating to travel within a geographic region is identified and presented to a user. A plurality of travel routes within the geographic region are stored. One or more types of travel information relating to the stored travel routes are also stored. The user identifies first and second geographic locations within the geographic region and at least one travel route between the identified geographic locations is electronically retrieved from the stored travel routes. Travel information corresponding to the retrieved travel route(s) is also retrieved from the stored one or more types of travel information. The retrieved travel route(s) and travel information is presented to a system user.

DESCRIPTION OF THE PREFERRED EMBODIMENT

Figure 1A:
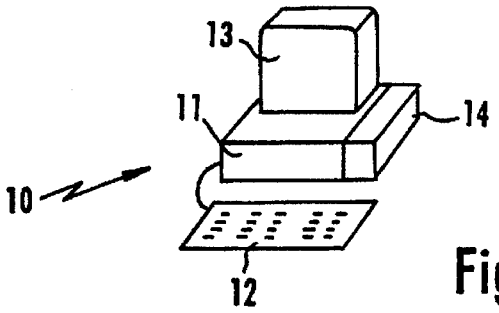
FIGS. 1(A)–1(D) depict various alternative stand alone systems in accordance with a first embodiment of the invention.
Figure 1B:
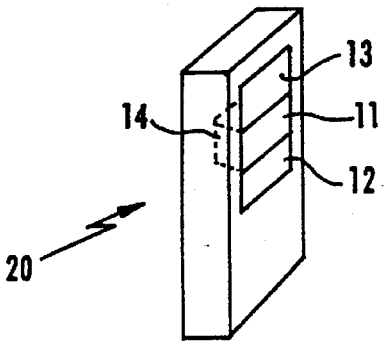
Figure 1C:
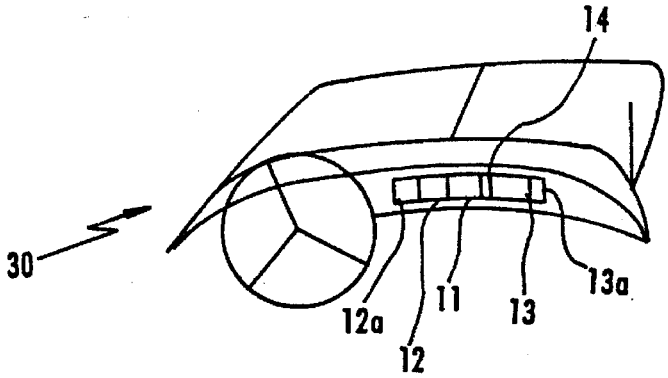
Figure 1D:
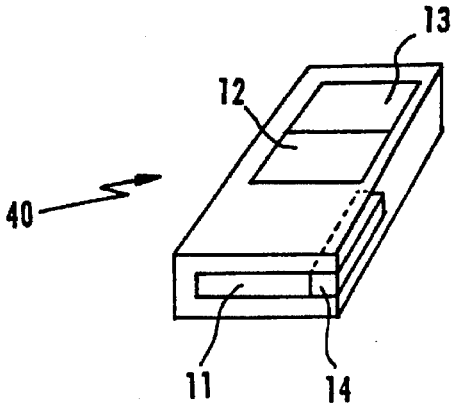

Before discussing the preferred embodiments of the invention it will be helpful to define certain terms which are used in this disclosure.

The term "Facility" or "Facilities" is used to refer to information such as commercial, tourist or industry establishments or services, for example hotels, campsites, service stations, restaurants, tourist attractions, truckstops, vehicle repair shops, and truck weight stations, truckstops etc. Facility information may include the establishment name and/or specific service offering, the hours of operation, the telephone number, available discounts, and other information which might be of interest to a traveler. A mileage and/or travel time indicator provides the location of each Facility on or in the vicinity of the travel route. It will understand that for a Condition the mileage and time indications may be presented to the traveler as a range, for example from mile 66 to mile 73.

The term "Landmark" or "Landmarks" refers to what might be characterized as logistical information, such as junctions of other routes with the travel route, jurisdictional lines between cities, towns, counties, states, or countries, metropolitan area boundaries, bridges, tunnels, driving time check points, and toll booths etc. Landmark information may be descriptively titled in its presentation to the user such as by the phrase "Approaching Washington, D.C. Area" or by some other descriptive phrase or term. Mileage and/or travel time indicators are presented with the Landmark information to provide locations along or in the vicinity of the travel route.

The term "Incident" or "Incidents" may include abnormal highway events, such as the location of a traffic accident, etc. Incident information may include a descriptive message, for example "Toxic Liquid Spill". The information is presented with mileage and/or travel time indicators to provide the location of the Incident on or in the vicinity of the travel route.

"Condition" or Conditions" information may include status type information on weather conditions, traffic conditions or back-ups, road construction and/or traffic detours, etc. Condition information may include a description of the conditions such as "Icy Road Conditions". Condition information is presented to the user with mileage and/or travel time indicators which identify the location of the Condition along or in the vicinity of the travel route. It will be understood that for a Condition the mileage and time indications may be presented to the traveler as a range, for example from mile 66 to mile 73.

Referring now to FIG. 1, there is shown stand alone system variations in accordance with a first embodiment of the present invention.

A desk top personal computer (PC) system 10, located for instance in a user's residence, has a microprocessor 11, electronic or magnetic storage 14, which may be a hard disk, diskette, ROM memory or compact disc (CD), an electronic data entry device 12, such as a keyboard, touch screen or voice recognition device, and a presentation device 13 which may include an electronic display, printer or voice synthesizer. Geographic locations representing the location at which overland travel will begin and end and the desired types of Facility, Landmark, Incident and Condition information are entered via the data entry device 12 and transmitted in a conventional manner to the microprocessor 11. The data entered by the user on data entry device 12 is preferably presented back to the user on the presentation device 13. The microprocessor 11 may require that the user confirm, via a further entry to the data entry device 12, the accuracy of the input data presented on the device 13 prior to retrieving information from the data bases stored in storage device 14. The user can either confirm that the input data presented on the device 13 is accurate or modify the presented data by entering revised data via the data entry device 12. Responsive to the confirmed input data the microprocessor 11 retrieves one or more travel routes between the identified locations, and the desired Facility, Landmark, Incident and Condition information corresponding to the retrieved route(s), are retrieved from data bases stored on the data storage device 14. The retrieved travel route(s) and Facility, Landmark, Incident and Condition information are tabulated by processor 11 and may be stored in storage device 14. The stored tabulated information may be useful for tracking and analyzing the travel routes and other information which are of greatest or least interest to users. The microprocessor 11 calculates mileage and/or travel time indicators which locate the Facilities, Landmarks, Incidents and Conditions along the retrieved travel route(s). The tabulated information and mileage and/or travel time indicators are presented to the user on presentation device 13.

Mileage indicates may, for example, be beneficially calculated to the nearest tenth of a mile for commercial travel or to nearest mile for leisure travel; however, it should be understood that any mileage indicator breakdown which is appropriate for the specific application could be utilized. Mileage indicators provide cumulative mileage along the application travel route. Distances between particular Facilities, Landmarks, Incidents and Conditions can be readily determined from the mileage indicators using simple subtraction. Time indicators may likewise be computed to the nearest minute, hour or any other unit of time as may be most appropriate for the particular application. Time indicators provide a cumulative estimated time of travel along the travel route. Accordingly, the estimated time for travel between Facilities etc. can also be easily determined from the travel time indicators using simple substraction. It will also be understood that if desired the processor 11 could be adapted using conventional techniques to compute the mileage and/or travel time between points along the travel route and present this information to the user. The estimated travel time can be calculated by processor 11 taking into account various factors associated with the speed which can be maintained along the travel route or portions therefor as well as the distance to be travelled.

Also depicted in FIG. 1 is a Kiosk system 20 which includes a microprocessor 11, data entry device 12, data storage device 14, and a presentation device 13, each of which is functionally identical to the identically numbered device described above in the description of the PC system 10, and hence, will not be further described below. The Kiosk may, for example, be located in a location which is convenient for an individual either anticipating future travel or presently traveling, to access travel routes and information stored on the data storage device 14. For example, the Kiosk could be located at a retail shopping mall, travel agency, restaurant, service station, lodging facility, airport, car rental facility, truck stop, or virtually any other location which might be convenient for an individual anticipating travel in the future, or in the course of a particular trip, to obtain information which may be of interest relating to a route of travel.

Referring again to FIG. 1, a vehicle system 30 is shown which includes an input device 12, a microprocessor 11, a data storage device 14, and a presentation device 13 all located in the dash panel of the vehicle. The microprocessor 11, input device 12, presentation device 13, and data storage device 14 are functionally identical to the identically numbered device described above in connection with PC system 10 and, therefore, will not be further described below to avoid unnecessary duplication. The vehicle system preferably has an optional voice recognition device 12*a* so that the driver of the vehicle may query the system and input data while maintaining proper control of the vehicle. The system also preferably includes an audio device 13*a*, such as a voice synthesizer, to audibly present information to the user. The vehicle system 30 is particularly beneficial to a traveler desiring to select or change the route of travel during the course of travel, or to inquire about Incidents or Conditions while traveling. It also allows additional flexibility in the event Incidents or Conditions occur during the course of travel. It will be understood that the location of the system components shown is only exemplary and that locations of one or more components elsewhere within the vehicle may be desirable for safety, convenience or other reasons.

Referring once again to FIG. 1, a portable personal hand-held computing system 40 is depicted having a microprocessor 11, data entry device 12, data presentation device 13, and storage device 14, each of which is functionally identical to the identically numbered device described above with reference to PC system 10. The portable hand-held system 40 is particularly useful in providing maximum flexibility to the traveler. For example, such a system would be very beneficial while traveling or touring on foot or by bicycle and would also provide virtually all of the advantages of the vehicle system 30 discussed above.

Figure 2:
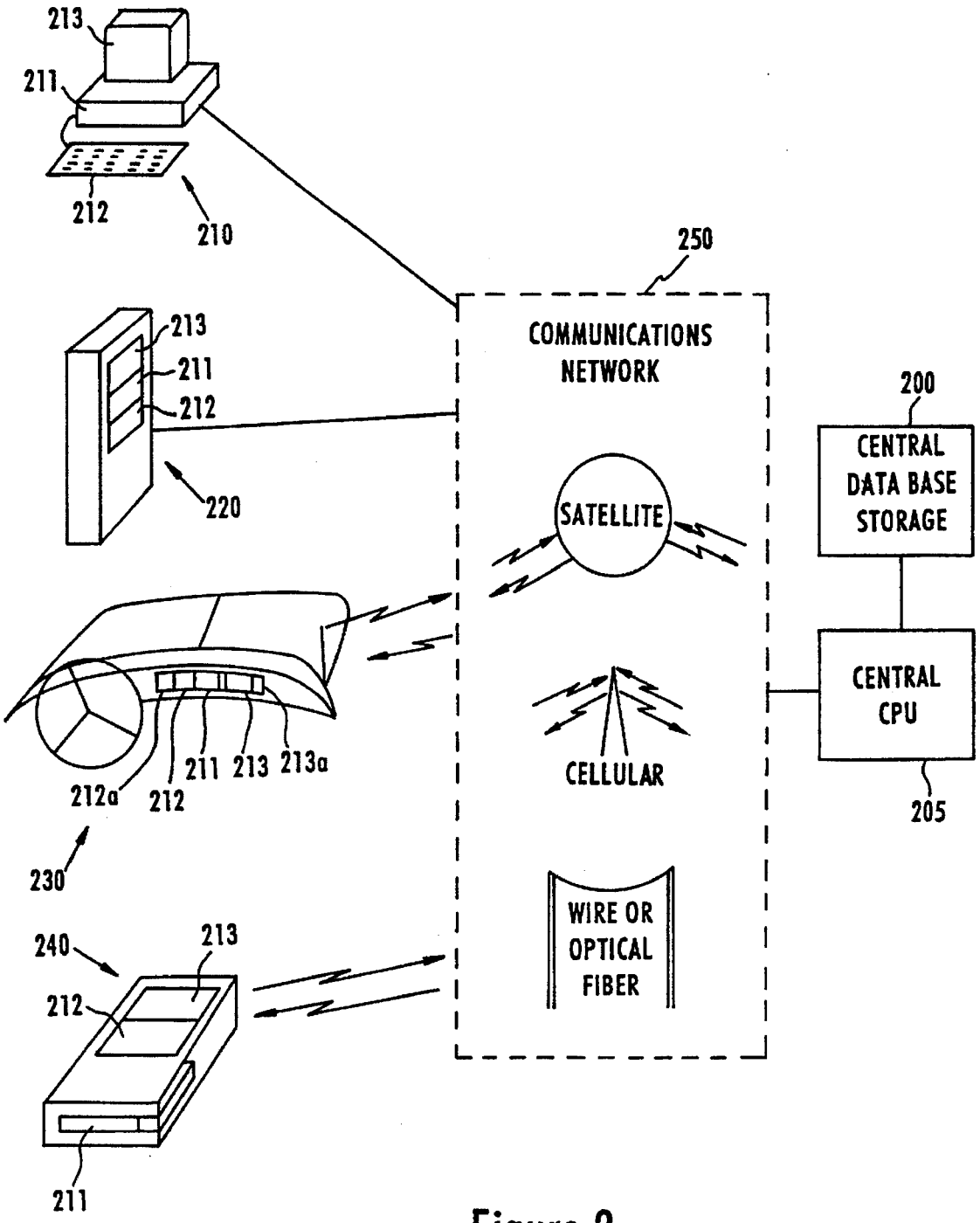
FIG. 2 depicts a centralized data base system in accordance with a second embodiment of the invention.

Referring now to FIG. 2, a travel information system is shown using a centralized electronic or magnetic data storage device 200 with a centralized processing unit (CPU) 205 which is accessed by the user via a communication network 250, such as a local area, wide area or public switch network which may include wire, optical or radio frequency, for example cellular and/or satellite, communications links. As shown, a desk top personal computer (PC) 210 has a data entry device 212 which is functionally identical to data entry device 12 of FIG. 1. The PC 210 also has a data presentation device 213 which is functionally identical to data presentation device 13 described above in connection with FIG. 1 and a microprocessor 211 for processing data input via the data entry device 212 and facilitating presentation, confirmation and, if applicable, modification of the input data. The processor 211 also facilitates transmission of the confirmed input data via, for example, a modem or other communication device (not shown) over the communication network 250 to the CPU 205. CPU 205, responsive to the received input data, accesses the central data base storage device 200 and retrieves travel routes and information conforming to the confirmed data input by user. Data base storage device 200 maintains travel routes and Facility, Landmark, Condition and Incident information which is identical to that maintained on storage device 14 of FIG. 1. The CPU 205 tabulates the retrieved travel route(s) and travel information, and stores the tabulated information on storage device 200. The CPU 205 also calculates mileage and/or travel time indicators which locate items of travel information with respect to the retrieved route(s). The CPU 205 then facilitates transmission of the tabulated information and mileage and/or travel time indicators via the network 250 to the PC 210. The microprocessor 211 processes the data received via the network 250 for presentation to the user via data presentation device 213.

Also shown in FIG. 2 is Kiosk 220 which includes a data entry device 212, microprocessor 211 and data presentation device 213 which are functionally identical to those described above in connection with PC 210 and therefore will not be further described below. As shown, the Kiosk is linked to the CPU 205 for access to the data storage device 200 via communications network 250. The kiosk may be located in any of the locations described above in connection with Kiosk system 20 of FIG. 1.

The vehicle dashboard 230 of FIG. 2 includes a data input device 212, processor 211 and data presentation device 213 all of which are identical to the corresponding devices described above. As shown, in order to access the centralized data bases on storage device 200, the data input on data entry device 212 is transmitted to the processor 211 which facilitates communication of the input data via the communications network 250 to CPU 205. In this case, the communications network preferably includes either a cellular communications link or a satellite communications link. As discussed above in connection with the vehicle system 30 of FIG. 1, it is also preferable that the data entry device at least alternatively include a voice recognition device 212*a*. It is also beneficial if the data presentation device 213 includes an audio device 213*a*, for example a voice synthesizer, which can audibly present the information transmitted back from CPU 205 in response to the user's input data.

The portable, personal hand-held communications device 240 shown in FIG. 2, includes microprocessor 211, data entry device 212 and data presentation device 213, all of which function identically to the identically numbered devices discussed above. As shown, data entered on the data entry device 212 is processed by microprocessor 211 and transmitted via communications network 250 to the central CPU 205.

The data input is processed by processor 211 for transmission via communications network 250 to CPU 205. The CPU 205 then accesses data base storage device 200 in response to the received input data and retrieves the route(s) and travel information, corresponding to the user input data, from data bases stored on device 200. The retrieved information is tabulated by CPU 205 and transmitted along with computed mileage and/or travel time indicators, via the communications network 250 to the hand-held computing device 240 where it is processed in processor 211 and presented to the user by the presentation device 213.

In each of the depicted devices 210–240, the input data is preferably presented back to the user by presentation device 213 and confirmed or modified by the user via data entry device 212.

Figure 3:
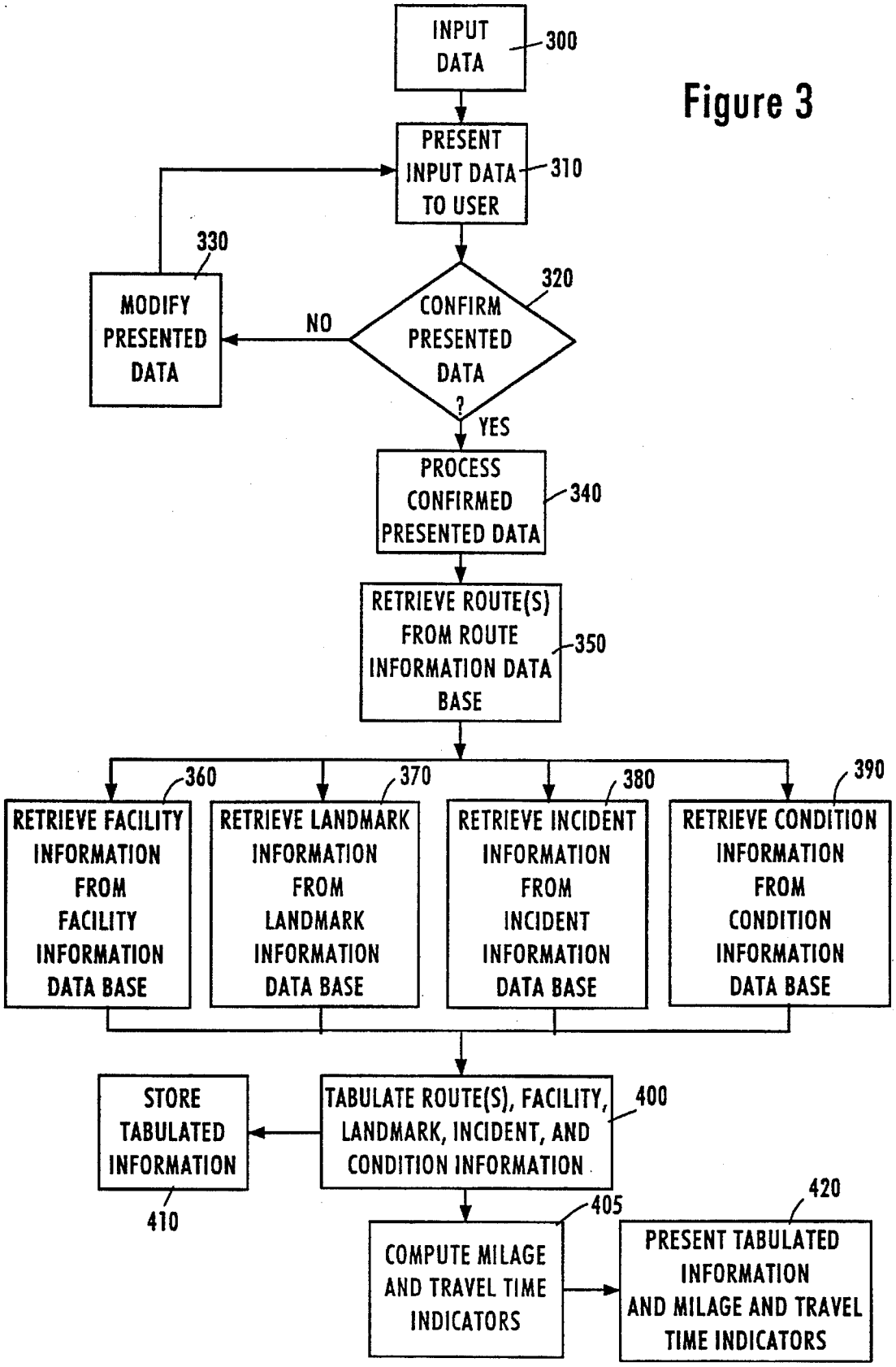
FIG. 3 depicts the steps performed by the first and second embodiments of the invention in identifying tabulating and presenting a travel route(s) and travel information of interest to a traveler.

Referring now to FIG. 3, the operation of the above embodiments of the invention will be further described. In step 300 a user inputs data on data entry device 12, 12*a*, 212 or 212*a* which includes a beginning and end location for travel, and preferably also includes a selection of route type such as highway, back roads, scenic route, etc. Beneficially, the input data also includes a selection of the types of Facilities, Landmarks, Incidents and Conditions of interest. The input data is presented to the user by data presentation device 13, 13*a*, 213 or 213*a*, as applicable, in step 310. The presented data can now be either confirmed in step 320 or modified as shown in step 330 by the user via input device 12, 12*a*, 212 or 212*a*, as applicable. If the presented input data is modified, the modified data is presented as indicated in step 310 for confirmation or further modification by the user. After the presented input data has been confirmed in step 320 it is either processed by processor 11 or transmitted via communications network 250 to CPU 205 and then processed by CPU 205 in step 340.

In step 350, the processor 11 or CPU 205 accesses the appropriate data bases stored in storage device 14 or 200, as applicable, and retrieves one or more routes corresponding to the input data route selection and identified start and end locations from the route selection data base stored in storage device 14 or 200. In step 360, the processor 11 or CPU 205, as applicable, retrieves Facility information corresponding to the types of Facility information selected, as represented by the input data, from the Facilities information data base stored on the storage device 14 or 200, as applicable. The retrieved Facility information will correspond to the route or routes retrieved in step 350. In step 370, processor 11 or CPU 205, as applicable, retrieves Landmark information corresponding to the route or routes retrieved in step 350 and corresponding also to the types of Landmark information selected by the user, as reflected by the input data, from the Landmark information data base stored on the storage device 14 or 200, as applicable. In step 380, the applicable processor retrieves, from the Incident data base stored on the applicable storage device, Incident information corresponding to the retrieved route or routes and to the selection of Incident information of interest to the traveler as reflected in the user input data. In step 390, the applicable processor retrieves, from the Conditions data base stored on the applicable storage device, the Condition information which corresponds to the route or routes selected in step 350 and to the type selection of Condition information of interest to the traveler, as reflected by the user input data. It will be understood that steps 360–390 may be performed serially or in parallel, as desired. It should also be understood that the information may be retrieved from the data bases stored on storage device 200 or 14 in any conventional manner or form. Additionally, any conventional method of searching the data bases for the responsive information can be utilized.

In step 400 the information retrieved in steps 350 through 390 is tabulated by processor 11 or 205, as applicable. Beneficially the tabulated information is stored on storage device 14 or 200 in step 410 so that it can be accessed to determine the types of information which are of most interest to system users. In step 405, mileage indicates locating the retrieved Facilities, Landmarks, Incidents and Conditions along the retrieved travel route(s) are computed. In step 420, the tabulated information and mileage and/or travel time indicators are presented to the user by presentation device 13, 13*a*, 213 or 213*a*, as applicable. In the case of the FIG. 1 embodiment, the presentation of the tabulated information and mileage indicators is direct via signals from processor 11 to presentation device 13 and/or 13*a*. In the case of the FIG. 2 embodiment, the tabulated information and mileage indicators are transmitted via the communications network 250 to processor 211 and then directed to presentation device 213 or 213*a* for presentation to the user.

In operation a user observing the presentation device and operating the data entry device inputs the selected origin and destination of travel, for example, "Sellersburg, Ind." to "Dallas, Tex". The origin and destination points may be entered by typing in or audibly stating the two locations. The system could also provide a displayed map on a touch screen so that, by touching the screen at the appropriate origin and destination locations, the appropriate data would be entered. As another alternative, a table of selectable locations could be displayed on the screen and, by scrolling or movement of a cursor, the point of origin and destination can be selected from the locations included in the table. The user next chooses the route class or type such as "direct" or "highway" or "scenic" or "shortest" route etc.

The user continues by selecting the types of Facilities, if any, which are of interest, such as "national parks and historic sites", and UNOCOL 76™ Service Stations" etc. The user may next select the Landmark information of interest, if any, such as "route junctions" and "state boundaries" etc. The user can next choose the type of Incidents information, if any, which is of interest, such as "traffic accidents" etc. Finally, the user can input the types, if any, of Condition information which may be of interest such as "road construction" and "icy road conditions" etc. The access to the data base is made in real time, i.e., the queries are made on-line. It will be understood by those skilled in the art that the Facility, Landmark, Condition and, Incident types can also be presented on a touch screen or in a table and selected in the manner described above in connection with the route selection.

In response, the user is presented with one or more travel routes, Facilities, Landmarks, Incidents, and Conditions of the type(s) selected. This information may be presented to the user in printed form, by electronic display, or by audio signal. The presented information may be in the form of a map with the tabulated information appropriately notated, or could be presented in non-graphic form such as in paragraph or tabular form. Mileage and/or travel time indicators reflecting total mileage/travel time and mileage/travel time associated with individual items of the tabulated information are included in the information presented. The processors beneficially include software or other conventional means to compute the mileage indication, along the retrieved travel route(s), for each individual item of travel information which is retrieved from the data bases.

The system and method described above allow the traveler to obtain information of interest regarding Facilities, Landmarks, Incidents and Conditions along a selected overland travel route without difficulty, even if the traveler is unfamiliar with the travel route. The system and method also allow a user to determine travel times without the need to perform measurements on a road map in order to estimate the travel time. The system and method allow the traveler to identify Facilities and Landmarks along the travel route which are of interest without reference to multiple travel directories or painstakingly measuring the locations of the Facilities and Landmarks on a road map to approximate the travel distance and time thereto. The system also allows a user to obtain Incident and Condition information and is particularly useful in providing such information in a real time fashion to the user.

The data bases stored in storage devices 14 and 200 may be easily updated by a communication link of the type previously described to a central control unit which downloads updated or additional information into the stored data bases. Alternatively, the data bases could be updated or enhanced by loading the updated or enhanced information locally on site, that is at the location where the data storage device 14 or 200 resides.

As set forth above, an improved system and method for identifying, tabulating and presenting information of interest to a traveler along an overland travel route is described without the limitations of convention systems and methods. The system can be used for virtually any type of travel related information which may be of interest to a traveler.

The novel features characteristics of the invention are set forth in the appended claims. The invention itself, however, as well as other features and advantages thereof, will be better understood by reference to a detailed description of preferred embodiments of the invention, when read in conjunction with the accompanying drawings. Although preferred embodiments are disclosed, it will be understood by those skilled in the art that the sequence of the steps could be varied and that the system configuration, as well as specific components and elements thereof, modified without deviating from the scope of the present invention. Further, it will be recognized by those skilled in the art that the system and method described and claimed herein could be easily adapted to travel other than overland travel, including but not limited to air, sea and inland waterway travel, without deviation from the scope of the claimed invention.

I claim:

1. A system for identifying and presenting information relating to travel within a geographic region, comprising:

means for storing (i) a plurality of travel routes within said geographic region and (ii) a plurality of different types of travel information associated with said plurality of travel routes;

means for inputting a first geographic location representing a start of travel location and a second geographic location representing an end of travel location within said geographic region, and for selecting at least one type of travel information from said stored plurality of different types of travel information;

a processing unit for (i) retrieving at least one travel route between said inputted first geographic location and said inputted second geographic location, from said stored plurality of travel routes, (ii) retrieving travel information of the selected at least one type corresponding to said retrieved at least one travel route, from said stored plurality of different types of travel information, (iii) calculating mileage and travel time indicators from said first geographic location which locate the retrieved travel information with respect to the retrieved at least one travel route and (iv) tabulating retrieved travel routes so as to determine travel routes most often retrieved and retrieved types of travel information so as to determine types of travel information most often selected; and means for presenting said retrieved (i) at least one travel route and (ii) travel information to a user of the system;

wherein said means presents said mileage and travel time indicators to the user.

2. A system according to claim 1, wherein said plurality of different types of travel information includes at least one of hotels, campsites, restaurants, service stations, truck weighing stations, truckstops, historic sites, junctions of other routes with said retrieved at least one travel route, tourist attractions, jurisdictional borders, road construction, weather conditions, and traffic accidents.

3. A system according to claim 1, wherein:

each of said stored plurality of travel routes corresponds to a category of roadway;

said means for inputting includes means for selecting a category of roadway; and said processing unit retrieves at least one travel route corresponding to the selected category of roadway.

4. A system according to claim 1, wherein:

said means for inputting includes at least one of a keyboard, touch screen and voice recognition device;

said means for storing is one of an electronic storage device or a magnetic storage device; and said means for presenting includes at least one of an electronic display, a printer or a voice synthesizer.

5. A system according to claim 1, further comprising means for transmitting (i) signals corresponding to said first geographic location and said second geographic location between said means for inputting and said processing unit and (ii) signals corresponding to said retrieved at least one travel route and said retrieved travel information, between said processing unit and said means for presenting.

6. A system according to claim 5, wherein said transmitted and received signals include radio frequency signals.

7. A system according to claim 5, wherein said means for transmitting includes a communications network.

8. A system according to claim 1, wherein said means for inputting and said means for presenting are located remote from said means for storing.

9. A system according to claim 7, wherein said means for inputting is located within one of the user's residence, the user's automotive vehicle, a portable personal communications device on the user's person, and a kiosk.

10. A method for identifying and conveying information relating to travel within a geographic region, comprising the steps of:

storing (i) a plurality of travel routes within said geographic region and (ii) a plurality of different types of travel information associated with one or more of said plurality of travel routes;

identifying a first geographic location representing a start of travel location and a second geographic location representing an end of travel location within said geographic region;

identifying at least one type of travel information from said stored plurality of different types of travel information;

electronically retrieving at least one travel route between said identified first geographic location and said identified second geographic location, from said stored plurality of travel routes;

electronically retrieving travel information of the identified at least one type corresponding to said retrieved at least one travel route, from said stored plurality of types of travel information;

tabulating retrieved travel routes so as to determine travel routes most often retrieved;

tabulating retrieved types of travel information so as to determine the types of travel information most often selected;

calculating mileage and travel time indicators from said first geographic location which locate the retrieved travel information with respect to the retrieved at least one travel route; and presenting (i) said retrieved at least one travel route, (ii) said retrieved travel information, and (iii) said mileage and travel time indicators to a user.

11. A method according to claim 10, wherein said plurality of types of travel information includes at least one of hotels, campsites, restaurants, service stations, truck weighing stations, truckstops, historic sites, junctions of other routes with said retrieved at least one travel route, tourist attractions, jurisdictional borders, road construction, weather conditions, and traffic accidents.

12. A system according to claim 10, further comprising the step of identifying a category of roadway desired by the user and wherein:

each of said stored plurality of travel routes corresponds to a category of roadway; and said step of retrieving at least one travel route includes retrieving at least one travel route corresponding to the identified category of roadway.

13. A method according to claim 10, further comprising the step of transmitting signals corresponding to said retrieved at least one travel route and said retrieved travel information to the user.

14. A method according to claim 13, wherein said transmitted signals include radio frequency signals.

* * * * *